US007391872B2

(12) United States Patent
Pompei

(10) Patent No.: US 7,391,872 B2
(45) Date of Patent: Jun. 24, 2008

(54) PARAMETRIC AUDIO SYSTEM

(76) Inventor: Frank Joseph Pompei, 16 Peck Ave., Wayland, MA (US) 01778

( * ) Notice: Subject to any disclaimer, the term of this patent is extended or adjusted under 35 U.S.C. 154(b) by 713 days.

(21) Appl. No.: 09/758,606

(22) Filed: Jan. 11, 2001

(65) Prior Publication Data

US 2001/0007591 A1 Jul. 12, 2001

Related U.S. Application Data

(63) Continuation-in-part of application No. 09/300,022, filed on Apr. 27, 1999.

(60) Provisional application No. 60/176,140, filed on Jan. 14, 2000.

(51) Int. Cl.
*H04R 3/00* (2006.01)

(52) U.S. Cl. ..... 381/111; 381/77; 367/119

(58) Field of Classification Search ..... 381/111–117, 381/160, 77, 91, 337, 340, 174, 82, 386, 381/361, 191, 79, 189; 367/118–119, 189
See application file for complete search history.

(56) References Cited

U.S. PATENT DOCUMENTS 3,373,251 A * 3/1968 Seeler ..... 381/353
3,398,810 A 8/1968 Clark, III ..... 181/0.5
3,565,209 A * 2/1971 Babcock et al. ..... 181/206
4,005,382 A * 1/1977 Beaver ..... 367/105
4,081,626 A 3/1978 Muggli et al. ..... 179/111
4,122,725 A * 10/1978 Thompson ..... 73/632
4,169,219 A * 9/1979 Beard ..... 369/47.25
4,246,449 A 1/1981 Biber ..... 179/111
4,258,332 A * 3/1981 West ..... 330/297
4,289,936 A * 9/1981 Civitello ..... 381/116
4,323,736 A * 4/1982 Strickland ..... 381/116
4,404,489 A 9/1983 Larson, III et al. ..... 310/334
4,588,917 A 5/1986 Ratcliff ..... 310/316

(Continued)

FOREIGN PATENT DOCUMENTS

EP 0 420 500 A2 9/1990

(Continued)

OTHER PUBLICATIONS

Acustica, vol. 4, 1954, No. 5, "Condenser Transmitters And Microphones With Solid Dieletric For Airborne Ultrasonics", W. Kuhl, G.R. Schodder nd F-K Schroder, III, Physikaliseches Institute der Universitat Gottingen, pp. 5-19-532.*

(Continued)

*Primary Examiner*—Vivian Chin
*Assistant Examiner*—Lun-See Lao
(74) *Attorney, Agent, or Firm*—Weingarten, Schurgin, Gagnebin & Lebovici LLP

(57) ABSTRACT

A parametric audio system having increased bandwidth for generating airborne audio signals with reduced distortion. The parametric audio system includes a modulator for modulating an ultrasonic carrier signal with a processed audio signal, a driver amplifier for amplifying the modulated carrier signal, and an array of acoustic transducers for projecting the modulated and amplified carrier signal through the air along a selected projection path to regenerate the audio signal. Each of the acoustic transducers in the array is a membrane-type transducer. Further, the acoustic transducer array is a phased array capable of electronically steering, focusing, or shaping one or more audio beams.

22 Claims, 7 Drawing Sheets

U.S. PATENT DOCUMENTS

| | | | | | |
|---|---|---|---|---|---|
| 4,603,408 | A | | 7/1986 | Singhal et al. | 367/92 |
| 4,695,986 | A | | 9/1987 | Hossack | 367/140 |
| 4,823,908 | A | | 4/1989 | Tanaka et al. | 181/175 |
| 4,887,248 | A | | 12/1989 | Griebeler | 367/181 |
| 4,963,782 | A | | 10/1990 | Bui et al. | 310/358 |
| 4,991,221 | A | * | 2/1991 | Rush | 381/120 |
| 5,161,128 | A | | 11/1992 | Kenney | 367/181 |
| 5,287,331 | A | | 2/1994 | Schindel et al. | 367/140 |
| 5,298,828 | A | * | 3/1994 | Radovanovich | 310/319 |
| 5,338,287 | A | * | 8/1994 | Miller et al. | 600/25 |
| 5,345,510 | A | * | 9/1994 | Singhi et al. | 381/77 |
| 5,394,732 | A | * | 3/1995 | Johnson et al. | 73/19.1 |
| 5,406,503 | A | * | 4/1995 | Williams et al. | 702/106 |
| 5,539,705 | A | | 7/1996 | Akerman et al. | 367/132 |
| 5,600,610 | A | | 2/1997 | Hill et al. | 367/181 |
| 5,619,476 | A | * | 4/1997 | Haller et al. | 367/181 |
| 5,745,438 | A | * | 4/1998 | Hill et al. | 367/181 |
| 5,859,915 | A | | 1/1999 | Norris | 381/75 |
| 5,870,351 | A | * | 2/1999 | Ladabaum et al. | 367/163 |
| 5,885,129 | A | * | 3/1999 | Norris | 446/405 |
| 5,910,991 | A | * | 6/1999 | Farrar | 381/59 |
| 5,982,709 | A | | 11/1999 | Ladabaum et al. | 367/170 |
| 6,016,351 | A | | 1/2000 | Raida et al. | 381/77 |
| 6,044,160 | A | | 3/2000 | Norris | 381/191 |
| 6,052,336 | A | * | 4/2000 | Lowrey, III | 367/139 |
| 6,229,899 | B1 | * | 5/2001 | Norris et al. | 381/77 |
| 6,445,804 | B1 | * | 9/2002 | Hirayanagi | 381/303 |
| 6,584,205 | B1 | * | 6/2003 | Croft et al. | 381/98 |
| 6,678,381 | B1 | * | 1/2004 | Manabe | 381/77 |

FOREIGN PATENT DOCUMENTS

| | | | | |
|---|---|---|---|---|
| EP | 0 973 149 | A2 | | 7/1999 |
| EP | 0 973 152 | A2 | | 7/1999 |
| GB | 2151025 | A | | 7/1985 |
| JP | 54034662 | A | * | 3/1979 |
| WO | WO/0011911 | | | 3/2000 |
| WO | WO/0108449 | A1 | | 2/2001 |
| WO | WO/0115491 | A1 | | 3/2001 |

OTHER PUBLICATIONS

Kamakura et al, Suitable Modulation of the Carrier Ultrasound for Parametric loudspeaker, pp. 215-217.*

10th International Symposium on Nonlinear Acoustics, *On The Feasibility Of Narrow Beam Speech Transmission In Air Using Non Linear Interaction Of Ultrasonic Waves*, Bindal Vishwa Nath. Saksena Tribhuwan Kimar and Mukesh Chandra, National Physical Laboratory, Hillside Road, New Delhi-110012, India, pp. 141-145, 1984.

Acustica, vol. 4, 1954, No. 5, *Condenser Transmitters And Michrophones With Solid Dielectric For Airborne Ultrasonics*, W. Kuhl, G.R. Schodder nd F-K Schroder, III. Physikaliseches Institute der Universitat Gottingen, pp. 519-532, 1954.

* cited by examiner

PARAMETRIC AUDIO SYSTEM

CROSS REFERENCE TO RELATED APPLICATIONS

This application is a continuation-in-part application of prior U.S. patent application Ser. No. 09/300,022 filed Apr. 27, 1999 entitled PARAMETRIC AUDIO SYSTEM.

This application claims priority of U.S. Provisional Patent Application No. 60/176,140 filed Jan. 14, 2000 entitled PARAMETRIC AUDIO SYSTEM.

STATEMENT REGARDING FEDERALLY SPONORED RESEARCH OR DEVELOPMENT

N/A

BACKGROUND OF THE INVENTION

The present invention relates generally to parametric audio systems for generating airborne audio signals, and more specifically to such parametric audio systems that include arrays of wide bandwidth membrane-type transducers.

Parametric audio systems are known that employ arrays of acoustic transducers for projecting ultrasonic carrier signals modulated with audio signals through the air for subsequent regeneration of the audio signals along a path of projection. A conventional parametric audio system includes a modulator for modulating an ultrasonic carrier signal with an audio signal, at least one driver amplifier for amplifying the modulated carrier signal, and one or more acoustic transducers for directing the modulated and amplified carrier signal through the air along a selected projection path. Each of the acoustic transducers in the array is typically a piezoelectric transducer. Further, because of the non-linear propagation characteristics of the air, the projected ultrasonic signal is demodulated as it passes through the air, thereby regenerating the audio signal along the selected projection path.

One drawback of the above-described conventional parametric audio system is that the piezoelectric transducers used therewith typically have a narrow bandwidth, e.g., 2-5 kHz. As a result, it is difficult to minimize distortion in the regenerated audio signals. Further, because the level of the audible sound generated by such parametric audio systems is proportional to the surface area of the acoustic transducer, it is generally desirable to maximize the effective surface area of the acoustic transducer array. However, because the typical piezoelectric transducer has a diameter of only about 0.25 inches, it is often necessary to include hundreds or thousands of such piezoelectric transducers in the acoustic transducer array to achieve an optimal acoustic transducer surface area, thereby significantly increasing the cost of manufacture.

Another drawback of the conventional parametric audio system is that the ultrasonic signal is typically directed along the selected projection path by a mechanical steering device. This allows the sound to be positioned dynamically or interactively, as controlled by a computer system. However, such mechanical steering devices are frequently expensive, bulky, inconvenient, and limited.

It would therefore be desirable to have a parametric audio system configured to generate airborne audio signals. Such a parametric audio system would provide increased bandwidth and reduced distortion in an implementation that is less costly to manufacture.

BRIEF SUMMARY OF THE INVENTION

In accordance with the present invention, a parametric audio system is provided that has increased bandwidth for generating airborne audio signals with reduced distortion. In one embodiment, the parametric audio system includes a modulator for modulating an ultrasonic carrier signal with at least one processed audio signal, at least one driver amplifier for amplifying the modulated carrier signal, and an array of acoustic transducers for projecting the modulated and amplified carrier signal through the air for subsequent regeneration of the audio signal along a selected projection path. Each of the acoustic transducers in the array is a membrane-type transducer. In a preferred embodiment, the membrane-type transducer is a Sell-type electrostatic transducer that includes a conductive membrane and an adjacent conductive backplate. In an alternative embodiment, the Sell-type electrostatic transducer includes a conductive membrane, an adjacent insulative backplate, and an electrode disposed on the side of the insulative backplate opposite the conductive membrane. The backplate preferably has a plurality of depressions formed on a surface thereof near the conductive membrane. The depressions in the backplate surface are suitably formed to set the center frequency of the membrane-type transducer, and to allow sufficient bandwidth to reproduce a nonlinearly inverted ultrasonic signal. Further, the driver amplifier includes an inductor coupled to the capacitive load of the membrane-type transducer to form a resonant circuit. In a preferred embodiment, the center frequency of the membrane-type transducer, the resonance frequency of the resonant circuit formed by the driver amplifier coupled to the membrane-type transducer, and the frequency of the ultrasonic carrier signal are equal to the same value of at least 45 kHz. The array of acoustic transducers is arranged in one or more dimensions and is capable of electronically steering at least one audio beam along the selected projection path. In one embodiment, the acoustic transducer array has a one-dimensional arrangement and is capable of electronically steering at least one audio beam in one (1) angular direction. In another embodiment, the acoustic transducer array has a two-dimensional arrangement and is capable of electronically steering at least one audio beam in two (2) angular directions. In a preferred embodiment, the acoustic transducer array is a one-dimensional linear array that steers, focuses, or shapes at least one audio beam in one (1) angular direction by distributing a predetermined time delay across the acoustic transducers of the array.

Other features, functions, and aspects of the invention will be evident from the Detailed Description of the Invention that follows.

BRIEF DESCRIPTION OF THE SEVERAL VIEWS OF THE DRAWING

The invention will be more fully understood with reference to the following Detailed Description of the Invention in conjunction with the drawings of which.

DETAILED DESCRIPTION OF THE INVENTION

U.S. patent application Ser. No. 09/300,022 filed Apr. 27, 1999 is incorporated herein by reference.

U.S. Provisional Patent Application No. 60/176,140 filed Jan. 14, 2000 is incorporated herein by reference.

Methods and apparatus are disclosed for directing ultrasonic beams modulated with audio signals through the air for subsequent regeneration of the audio signals along selected paths of projection. The presently disclosed invention directs such modulated ultrasonic beams through the air by way of a parametric audio system configured to provide increased bandwidth and reduced distortion in an implementation that is less costly to manufacture.

Figure 1:
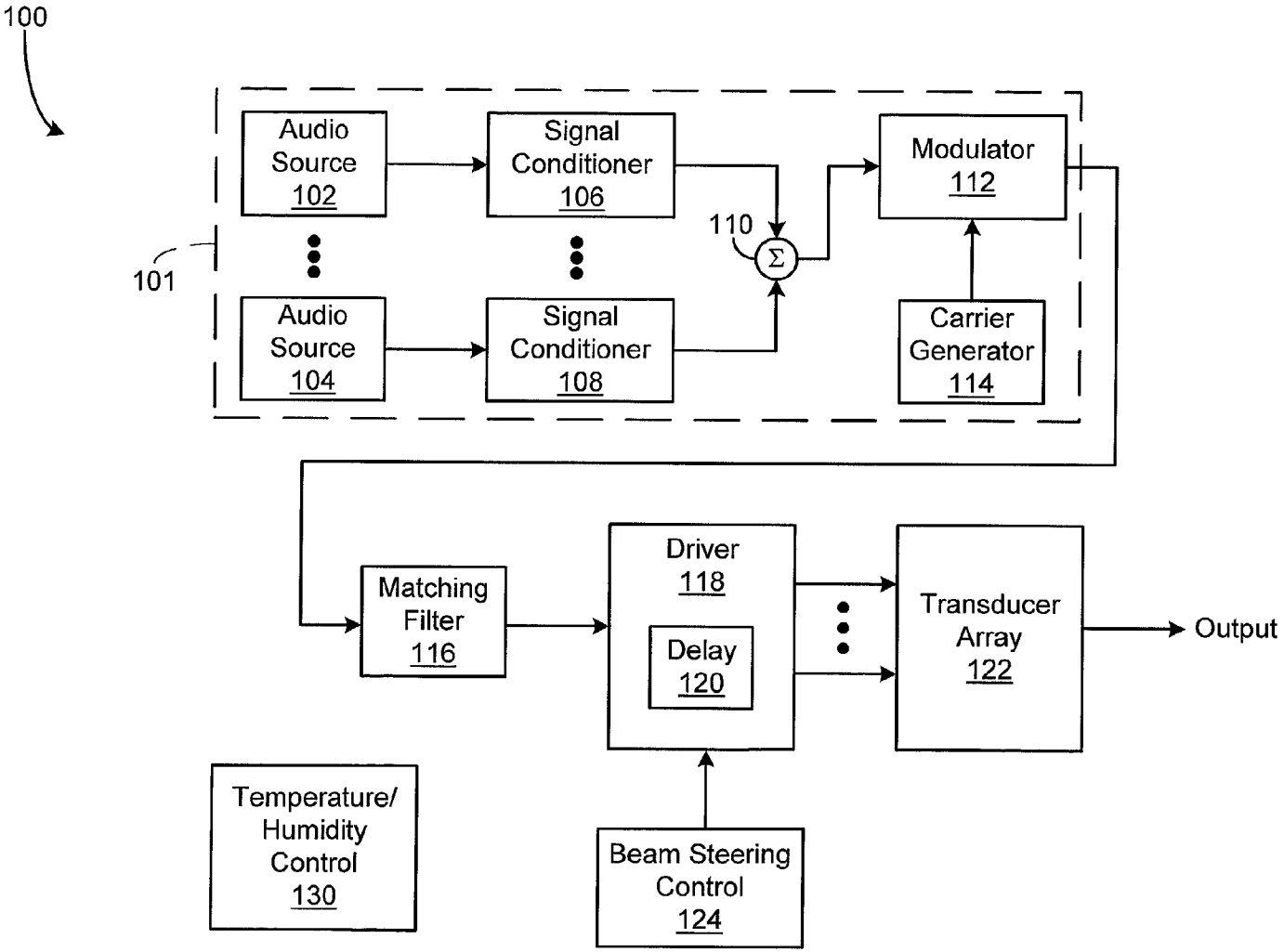
FIG. 1 is a block diagram of a parametric audio system in accordance with the present invention.

FIG. 1 depicts a block diagram of an illustrative embodiment of a parametric audio system 100 according to the present invention. In the illustrated embodiment, the parametric audio system 100 includes an acoustic transducer array 122 comprising a plurality of acoustic transducers arranged in a one, two, or three-dimensional configuration. The acoustic transducers of the array are driven by a signal generator 101, which includes an ultrasonic carrier signal generator 114 and one (1) or more audio signal sources 102-104. Optional signal conditioning circuits 106-108 receive respective audio signals generated by the audio signal sources 102-104, and provide conditioned audio signals to a summer 110. It is noted that such conditioning of the audio signals may alternatively be performed after the audio signals are summed by the summer 110. In either case, the conditioning typically comprises a nonlinear inversion that is necessary to reduce or eliminate distortion in the reproduced audio and generally expands the need for ultrasonic bandwidth. The conditioning may additionally comprise standard audio production routines such as equalization (of audio) and compression. A modulator 112 receives a composite audio signal from the summer 110 and an ultrasonic carrier signal from the carrier generator 114, and modulates the ultrasonic carrier signal with the composite audio signal. The modulator 112 is preferably adjustable in order to vary the modulation index. Amplitude modulation by multiplication with a carrier is preferred, but because the ultimate goal of such modulation is to convert audio-band signals into ultrasound, any form of modulation that can have that result may be used.

In a preferred embodiment, the modulator 112 provides the modulated carrier signal to a matching filter 116, which is configured to compensate for the generally non-flat frequency response of the driver amplifier 118 and the acoustic transducer array 122. The matching filter 116 provides the modulated carrier signal to at least one driver amplifier 118, which in turn provides an amplified version of the modulated carrier signal to at least a portion of the plurality of acoustic transducers of the acoustic transducer array 122. The driver amplifier 118 may include a delay circuit 120 that applies a relative phase shift across all frequencies of the modulated carrier signal in order to steer, focus, or shape the ultrasonic beam provided at the output of the acoustic transducer array 122. The ultrasonic beam, which comprises the high intensity ultrasonic carrier signal amplitude-modulated with the composite audio signal, is demodulated on passage through the air due to the non-linear propagation characteristics of the propagation medium to generate audible sound. It is noted that the audible sound generated by way of this non-linear parametric process is approximately proportional to the square of the modulation envelope. Accordingly, to reduce distortion in the audible sound, the signal conditioners 106-108 preferably include nonlinear inversion circuitry for inverting the distortion that would otherwise result in the audible signal. For most signals, this inversion approximates taking a square root of the signal, after appropriate offset. Further, to increase the level of the audible sound, the acoustic transducer array 122 is preferably configured to maximize the effective surface area of the plurality of acoustic transducers.

The frequency of the carrier signal generated by the ultrasonic carrier signal generator 114 is preferably on the order of 45 kHz or higher, and more preferably on the order of 55 kHz or higher. Because the audio signals generated by the audio signal sources 102-104 typically have a maximum frequency of about 20 kHz, the lowest frequency components of substantial intensity according to the strength of the audio signal in the modulated ultrasonic carrier signal have a frequency of about 25-35 kHz or higher. Such frequencies are typically above the audible range of hearing of human beings.

Figure 2A:
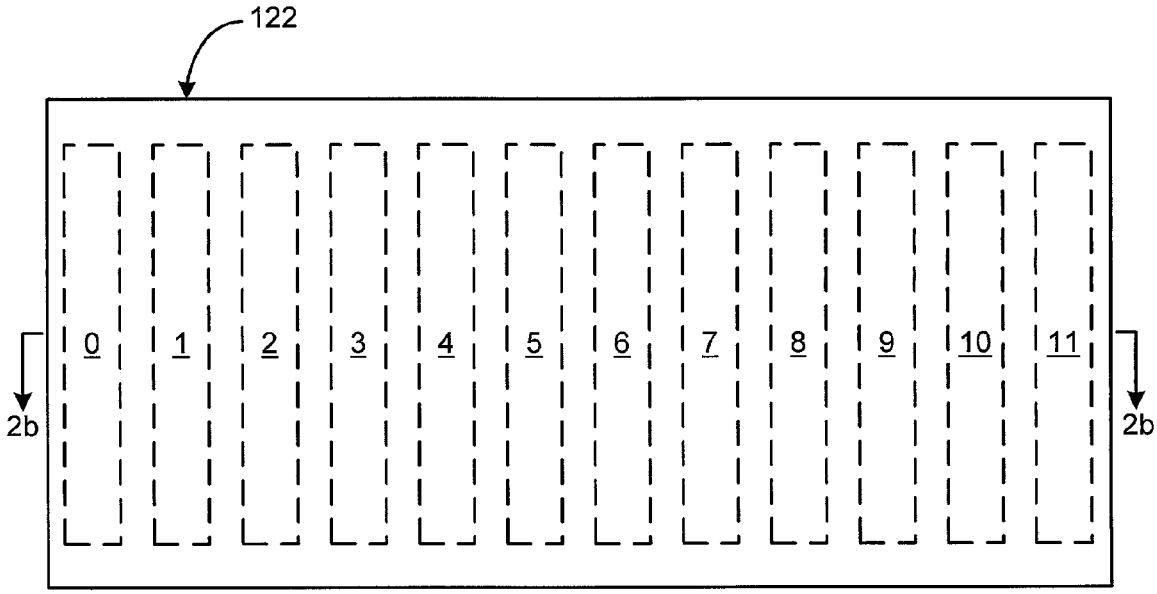
FIG. 2*a* is a simplified plan view of an array of acoustic transducers included in the parametric audio system of FIG. 1.

FIG. 2*a* depicts a simplified plan view of an illustrative embodiment of the acoustic transducer array 122 included in the parametric audio system 100 (see FIG. 1). As described above, the acoustic transducer array 122 includes a plurality of acoustic transducers arranged in a configuration having one or more dimensions. Accordingly, the exemplary acoustic transducer array 122 includes a plurality of acoustic transducers 0-11 (shown in phantom) arranged in a one-dimensional configuration. Each of the acoustic transducers 0-11 comprises a capacitor transducer, and more particularly a membrane-type transducer such as a membrane-type PVDF transducer, a membrane-type electret transducer, or a membrane-type electrostatic transducer. The membrane-type transducer has a loudness figure of merit, 1, defined as $$1=(\text{Area})\cdot(\text{Amplitude})^2, \quad (1)$$

in which "Area" is the area of the membrane-type transducer and "Amplitude" is the amplitude of the modulated ultrasonic carrier signal. The loudness figure of merit is preferably greater than $(2.0\times10^4)$ $Pa^2\cdot in^2$, and more preferably greater than $(4.5\times10^5)$ $Pa^2\cdot in^2$. In the illustrated embodiment, each of the acoustic transducers 0-11 has a generally rectangular shape to facilitate close packing in the one-dimensional configuration. It should be understood that other geometrical shapes and configurations of the acoustic transducers may be employed. For example, the acoustic transducers may be suitably shaped for arrangement in an annular configuration.

Figure 2B:
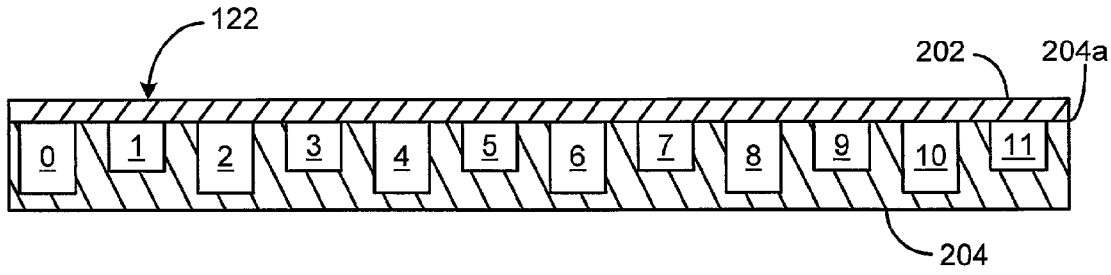
FIG. 2*b* is a cross-sectional view of the acoustic transducer array of FIG. 2*a;*

FIG. 2*b* depicts a cross-sectional view of the acoustic transducer array 122 of FIG. 2*a*. As mentioned above, the acoustic transducers 0-11 are membrane-type transducers. In a preferred embodiment, each of the acoustic transducers 0-11 is a Sell-type electrostatic transducer. Accordingly, the acoustic transducer array 122 includes an electrically conductive membrane 202 that is conductive on at least one side, which opposes an adjacent backplate electrode 204. For example, the membrane 202 may comprise a kapton membrane with one-sided metalization. Further, a surface 204*a* of the backplate electrode 204 is interrupted by a plurality of rectangular grooves of varying depth to form the acoustic transducers 0-11. In the exemplary embodiment, the acoustic transducer array 122 includes suitable structure, e.g., a leaf spring (not shown), for forcing the membrane 202 against the surface 204*a* of the backplate electrode 204. Thus, the acoustic transducer array 122 includes the plurality of acoustic transducers 0-11 as defined by the membrane 202 and respective edges of the plurality of rectangular grooves. In an alternative embodiment, the acoustic transducer array 122 may include the conductive membrane 202, a conductive electrode (not shown), and an insulative backplate (not shown) having a surface interrupted by a plurality of rectangular grooves and disposed between the membrane 202 and the electrode.

The bandwidth of the acoustic transducer array 122 is preferably on the order of 5 kHz or higher, and more preferably on the order of 10 kHz or higher as enhanced by the matching filter 116. Further, by suitably setting the depth of the grooves forming the acoustic transducers 0-11, the frequency response of the acoustic transducer array 122 can be set to satisfy the requirements of the target application. For example, the center frequency of the acoustic transducer array 122 may be made lower by increasing the depth of the grooves, and bandwidth can be extended by varying the groove depths about the transducer. The center frequency of the acoustic transducer array 122 is also affected by, e.g., the tension of the membrane 202 and the width of the grooves, as described in co-pending U.S. patent application Ser. No. 09/300,200 filed Apr. 27, 1999 entitled ULTRASONIC TRANSDUCERS, which is incorporated herein by reference. In a preferred embodiment, the center frequency of the acoustic transducer array 122 and the frequency of the carrier signal generated by the ultrasonic carrier signal generator 114 are equal to the same value of at least 45 kHz.

Those of ordinary skill in the art will appreciate that the time-varying ultrasonic carrier signal provided to the acoustic transducers 0-11 of the array 122 generates a varying electric field between the conductive membrane 202 and the backplate electrode 204 that deflects the membrane 202 into and out of the depressions formed in the surface 204*a* of the backplate electrode 204 by the plurality of rectangular grooves. In this way, the ultrasonic carrier signal causes the membrane 202 to vibrate at a rate corresponding to the frequency of the electric field, thereby causing the acoustic transducer array 122 to generate sound waves.

Figure 3:
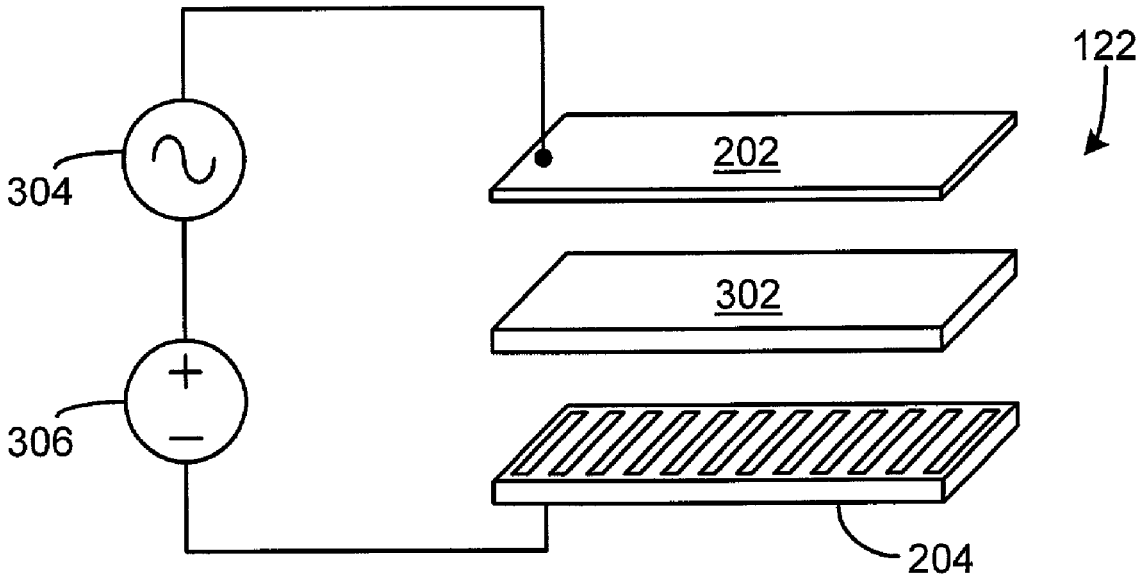
FIG. 3 is a simplified, exploded perspective view of the acoustic transducer array of FIG. 2*b;*

FIG. 3 depicts a simplified, exploded perspective view of the acoustic transducer array 122 included in the parametric audio system 100 (see FIG. 1). As shown in FIG. 3, the acoustic transducer array 122 includes the conductive membrane 202 and the backplate electrode 204. Because each of the acoustic transducers 0-11 is preferably a Sell-type electrostatic transducer that may require a DC bias applied thereto, a DC bias source 306 (e.g., 150 $V_{DC}$) is connected across the conductive membrane 202 and the backplate electrode 204. The DC bias source 306 increases the sensitivity of the acoustic transducer array 122 and reduces ultrasonic distortion in the sonic beam generated by the acoustic transducer array 122. The DC bias may alternatively be provided by the internal charge of a component of the transducer, preferably the membrane, in the form of an electret. FIG. 3 further depicts an AC source 304 serially connected to the DC bias source 306 that generates a time-varying signal representative of the modulated ultrasonic carrier signal provided to the acoustic transducer array 122 by the driver amplifier 118.

Moreover, FIG. 3 depicts an optional dielectric spacer 302 disposed between the conductive membrane 202 and the backplate electrode 204. In one embodiment, the dielectric spacer 302 is configured to fill the depressions formed in the surface 204*a* (see FIG. 2*b*) of the backplate electrode 204 by the plurality of rectangular grooves. For example, the dielectric spacer 302 may be provided to increase the electric field formed between the backplate electrode 204 and the conductive membrane 202, thereby generating an increased amount of force on the membrane 202 and enhancing the performance of the acoustic transducer array 122. In another embodiment, an acoustic horn (not shown) is operatively disposed near the membrane 202 to provide for improved impedance matching between the acoustic transducer array 122 and the air, and/or to vary the distribution of ultrasonic beams projected along the selected projection paths.

Figure 4:
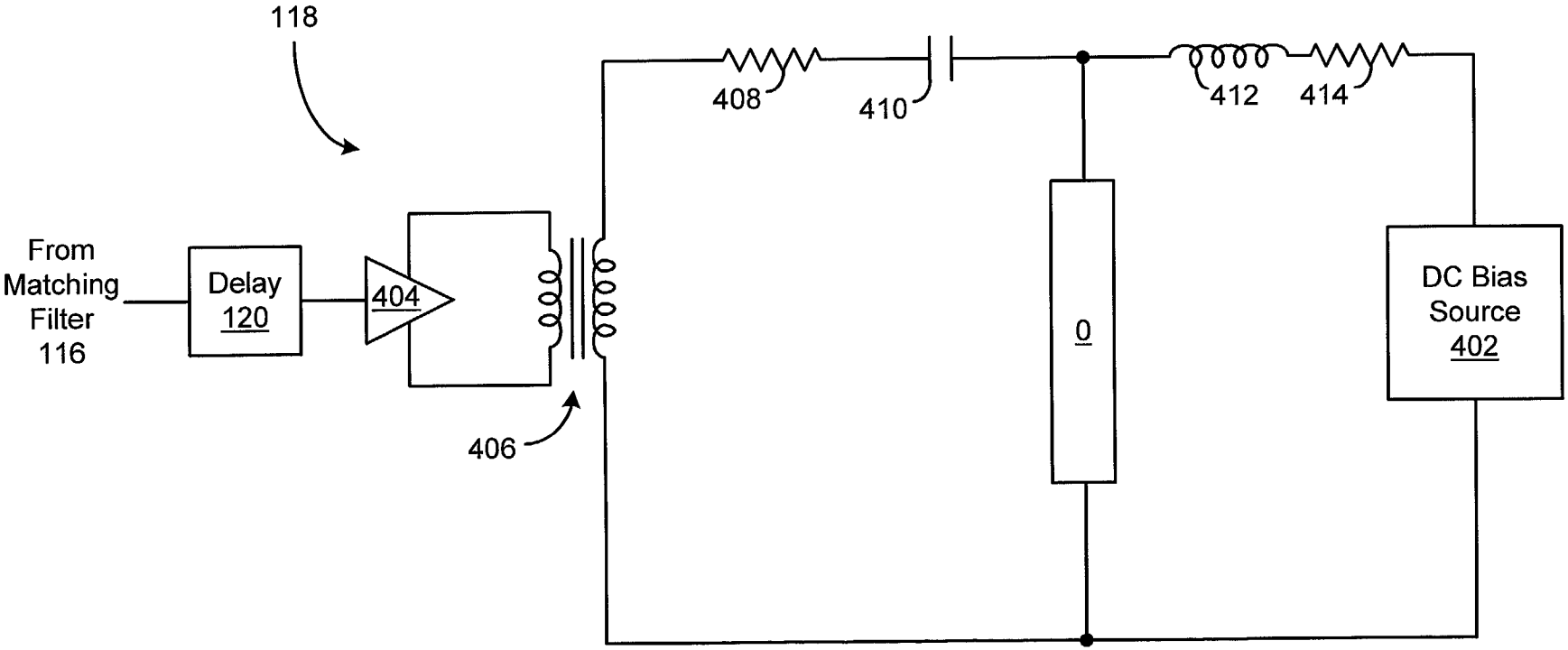
FIG. 4 is a schematic diagram of a driver amplifier circuit included in the parametric audio system of FIG. 1.

FIG. 4 depicts a schematic diagram of the driver amplifier 118 (see FIG. 1) including the delay circuit 120 (see FIG. 1). It is understood that the driver amplifier 118 may be suitably configured for driving either a portion or all of the acoustic transducers 0-11 included in the acoustic transducer array 122. It is also noted that a respective delay circuit 120 is preferably provided for each one of the acoustic transducers 0-11. FIG. 4 shows the driver amplifier 118 driving only the acoustic transducer 0 for clarity of discussion.

As shown in FIG. 4, the delay circuit 120 receives the modulated carrier signal from the matching filter 116 (see FIG. 1), applies a relative phase shift to the modulated carrier signal for steering/focusing/shaping the ultrasonic beam generated by the acoustic transducer array 122, and provides the modulated carrier signal to an amplifier 404. The primary winding of a step-up transformer 406 receives the output of the amplifier 404, and the secondary winding of the transformer 406 provides a stepped-up voltage (e.g., 200-300 $V_{P\text{-}P}$) to the series combination of the acoustic transducer 0, a resistor 408, and a blocking capacitor 410. The resistor 408 provides a measure of damping to broaden the frequency response of the driver amplifier 118. Further, a DC bias is applied to the acoustic transducer 0 from a DC bias source 402 by way of an isolating inductor 412 and a resistor 414. The capacitor 410 has relatively low impedance and the inductor 412 has relatively high impedance at the operating frequency of the driver amplifier 118. Accordingly, these components typically have no effect on the operation of the circuit except to isolate the AC and DC portions of the circuit from each other. For example, the impact of the blocking capacitor 410 on the electrical resonance properties of the driver amplifier 118 may be reduced if the capacitor 410 has a value that is significantly greater than the capacitance of the acoustic transducer 0. The capacitance of the blocking capacitor 410 may also be used to tune the capacitance of the acoustic transducer 0, thereby tailoring the resonance properties of the driver amplifier 118. In an alternative embodiment, the inductor 412 may be replaced by a very large resistor value. It is noted that the blocking capacitor 410 may be omitted when the DC bias is provided by an electret.

As explained above, the matching filter 116 (see FIG. 1) may be provided just before the driver amplifier 118 to compensate for the generally non-flat frequency response of the driver amplifier 118 and the acoustic transducer array 122. It is noted that the matching filter 116 may be omitted when the combination of the driver amplifier 118 and the acoustic transducer 0 provides a relatively flat frequency response. In a preferred embodiment, the matching filter 116 is configured to perform the function of a band-stop filter for essentially inverting the band-pass nature of the driver amplifier 118 and the acoustic transducer 0. It is further noted that the frequency response of the combination of the driver amplifier 118 and the acoustic transducer 0 is preferably either consistent so that the matching filter 116 can be reliably reproduced, or measurable so that the matching filter 116 can be tuned during manufacture or in the field. In an alternative embodiment, the matching filter 116 is provided before the modulator 112 (see FIG. 1) with suitable frequency mapping. Such an alternative embodiment may be employed for digital implementations of the parametric audio system 100 (see FIG. 1).

In a preferred embodiment, the secondary winding of the transformer 406 is configured to resonate with the capacitance of the acoustic transducer 0 at the center frequency of the acoustic transducer 0, e.g., 45 kHz or higher. This effectively steps-up the voltage across the acoustic transducer and provides a highly efficient coupling of the power from the driver amplifier 118 to the acoustic transducer. Without the resonant circuit formed by the secondary winding of the transformer 406 and the acoustic transducer capacitance, the power required to drive the parametric audio system 100 is very high, i.e., on the order of hundreds of watts. With the resonant circuit, the power requirement reduction corresponds to the Q-factor of resonance. It is noted that in the illustrated embodiment, the capacitive load of the acoustic transducer functions as a "charge reflector". In effect, charge "reflects" from the acoustic transducer when the transducer is driven and is "caught" by the secondary winding of the transformer 406 to be reused. The electrical resonance frequency of the driver amplifier 118, the center frequency of the acoustic transducer 0, and the ultrasonic carrier frequency preferably have the same frequency value.

It should be understood that the transformer 406 may alternatively be provided with a relatively low secondary inductance, and an inductor (not shown) may be added in series with the acoustic transducer 0 to provide the desired electrical resonance frequency. Further, if the transformer 406 has an inductance that is too large to provide the desired resonance, then the effective inductance may be suitably reduced by connecting an inductor in parallel with the secondary winding. It is noted that the cost as well as the physical size and weight of the driver amplifier 118 may be reduced by suitably configuring the secondary inductance of the transformer 406. It is further noted that an acoustic transducer array having acoustic transducers with different center frequencies may be driven by a plurality of driver amplifiers tuned to the respective center frequencies.

As described above, the delay circuit 120 (see FIG. 1) applies a relative phase shift across all frequencies of the modulated carrier signal so as to steer, focus, or shape ultrasonic beams generated by the acoustic transducer array 122. The acoustic transducer array 122, particularly the one-dimensional acoustic transducer array 122 of FIG. 2*a*, is therefore well suited for use as a phased array. Such phased arrays may be employed for electronically steering audio beams toward desired locations along selected projection paths, without requiring mechanical motion of the acoustic transducer array 122. Further, the phased array may be used to vary audio beam characteristics such as the beam width, focus, and spread. Still further, the phased array may be used to generate a frequency-dependent beam distribution, in which modulated ultrasonic beams with different frequencies propagate through the air along different projection paths. Moreover, a suitably controlled phased array may transmit multiple ultrasonic beams simultaneously so that multiple audible beams are generated in the desired directions.

Specifically, the acoustic transducer array 122 is configured to operate as a phased array by manipulating the phase relationships between the acoustic transducers included therein to obtain a desired interference pattern in the ultrasonic field. For example, the one-dimensional acoustic transducer array 122 (see FIG. 2*a*) may manipulate the phase relationships between the acoustic transducers 0-11 by way of the delay circuit 120 (see FIG. 1) so that constructive interference of ultrasonic beams occurs in one direction. As a result, the one-dimensional acoustic transducer array 122 steers the modulated ultrasonic beam in that direction electronically. For example, a rich, flexible audio scene of many dynamic sound objects may be generated by changing the direction of the modulated ultrasonic beam in this manner in real-time (e.g., via a computerized beam steering control device 124, see FIG. 1).

In a preferred embodiment, the delay circuit 120 (see FIG. 1) linearly distributes a predetermined time delay across the acoustic transducers 0-11 (see FIG. 2*a*), the slope of which is proportional to the sine of the steering angle, θ. In a preferred embodiment, the delay circuit 120 applies a time delay, d, defined as $$d=(x\cdot\sin(\theta))/c, \tag{2}$$

in which "x" is the distance from one of the acoustic transducers 0-11 and the location of the acoustic transducer 0 in the array 122, and "c" is the speed of sound.

This phased array technique can be used to produce arbitrary interference patterns in the ultrasound field and therefore arbitrary distributions of regenerated audio signals, much like holographic reconstruction of light. Although this technique can be used for electronically steering, focusing, or shaping a single modulated ultrasonic beam by way of the acoustic transducer array 122 (see FIG. 2*a*), it is noted that it may also be used to create a sonic environment containing multiple, arbitrarily shaped and distributed audible sound sources.

The efficiency of demodulation of the ultrasonic beam to provide audible sound is a direct function of the absorption rate of the ultrasound and therefore the atmospheric conditions such as temperature and/or humidity. For this reason, the parametric audio system 100 preferably includes a temperature/humidity control device 130 (see FIG. 1). For example, the temperature/humidity control device 130 may include a thermostatically controlled cooler, or a dehumidifier that maintains desired atmospheric conditions along the path traversed by the ultrasonic beam. In general, at ultrasonic frequencies, it is desirable to provide cooler, dry air to minimize absorption and maximize performance. Other agents such as stage smoke may also be injected into the air to increase the efficiency of demodulation.

Figure 5:
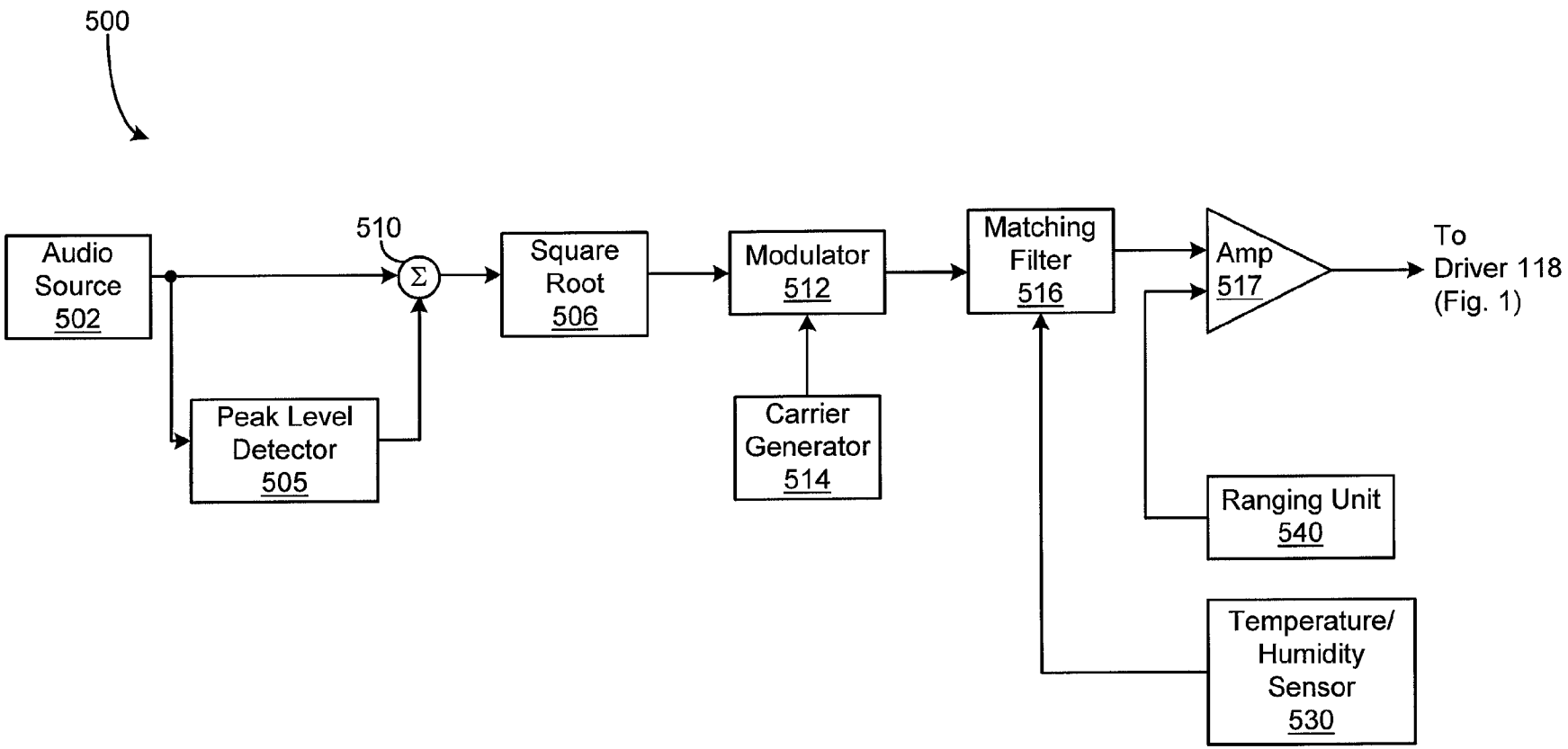
FIG. 5 is a partial block diagram of an adaptive parametric audio system in accordance with the present invention.

FIG. 5 depicts an adaptive parametric audio system 500, which is a preferred embodiment of the parametric audio system 100 (see FIG. 1). As shown in FIG. 5, an audio signal source 502 provides an audio signal to a peak level detector 505, and the audio signal and the output of the peak level detector 505 are provided to a summer 510. A square root circuit 506 receives the sum of the audio signal and the peak level detector 505 output from the summer 510. As described above, the square root of the audio signal is preferably taken before the signal is provided to the modulator so as to reduce distortion in the audible sound. In the adaptive parametric audio system 500, the square root circuit 506 in combination with the peak level detector 505 is configured to perform a nonlinear inversion of the audio signal to reduce the audible distortion. In alternative embodiments, the square root function performed by the circuit 506 may be replaced by a suitable polynomial, a lookup table, or a spline curve. The square root circuit 506 provides the square root of the sum of the audio signal and the peak level detector 505 output to a modulator 512, which modulates an ultrasonic carrier signal provided by a carrier generator 514 with the composite signal. The modulated carrier is then provided to a matching filter 516, and the output of the matching filter 516 is applied to an amplifier 517 before passing to the driver circuit 118 (see FIG. 1).

The adaptive parametric audio system 500 generates an audible secondary beam of sound by transmitting into the air a modulated, inaudible, primary ultrasonic beam. For a primary beam defined as $$p_1(t)=P_1E(t)\sin(\omega_c t), \tag{3}$$

in which "$P_1$" is the carrier amplitude and "$\omega_c$" is the carrier frequency, a reasonable reproduction of an audio signal, g(t), is obtained when $$E(t)=(1+\int\int mg(t)dt^2)^{1/2}, \tag{4}$$

in which "m" is the modulation depth and "g(t)" is normalized to a peak value of unity. The resulting audible secondary beam may be expressed as $$p_2(t)\propto P_1^2(d^2E^2(t)/dt^2)$$

$$p_2(t)\propto P_1^2 mg(t)$$

$$p_2(t)\propto g(t), \tag{5}$$

in which the symbol "∝" represents the phrase "approximately proportional to".

The adaptive parametric audio system 500 controls both the modulation depth and the overall primary signal amplitude, $P_1$, to (1) maximize the modulation depth (while keeping it at or below a target value, e.g., 1), (2) maintain an audible level corresponding to the level of the audio signal, g(t), by appropriately adjusting $P_1$, and (3) ensure that when there is no audio signal present, there is little or no ultrasound present. The parametric audio system 500 is configured to perform these functions by measuring the peak level, L(t), of the integrated (i.e., equalized) audio signal, and synthesizing the transmitted primary beam, p'(t), defined as $$p'(t)=P_1(L(t)+m\int\int g(t0dt^2)^{1/2}\sin(\omega_c t), \tag{6}$$

in which "L(t)" is the output of the peak level detector 505 and the sum "$L(t)+m\int\int g(t)dt^2$" is the output of the summer 510. The square root of the sum "$L(t)+m\int\int g(t)dt^2$" is provided at the output of the square root circuit 506, and the multiplication by "$P_1\sin(\omega_c t)$" is provided by the modulator 512.

Atmospheric demodulation of the modulated ultrasonic signal results in an audio signal, $P'_2(t)$, which may be expressed as $$p'_2(t)\propto d^2E^2(t)/dt^2\ p'_2(t)\propto d^2(L(t)+m\int\int g(t)dt^2)/dt^2\ p'_2(t)$$
$$\propto d^2L(t)/dt^2+mg(t). \tag{7}$$

The signal "$p'_2(t)$" includes the desired audio signal, mg(t), and a residual term involving the peak detection signal, L(t). In the illustrated embodiment, the peak level detector 505 is provided with a short time constant for increases in g(t) peak, and a slow decay (i.e., a long time constant) for decreases in g(t) peak. This reduces the audible distortion in the first term of equation (6) (i.e., $d^2L(t)/dt^2$), and shifts it to relatively low frequencies.

To reduce the possibility of exceeding an allowable ultrasound exposure, a ranging unit 540 is provided for determining the distance to the nearest listener and appropriately adjusting the output of the adaptive parametric audio system 500 by way of the amplifier 517. For example, the ranging unit 540 may comprise an ultrasonic ranging system, in which the modulated ultrasound beam is augmented with a ranging pulse. The ranging unit 540 detects the return of the pulse, and estimates the distance to the nearest object by measuring the time between the pulse's transmission and return.

Figure 6A:
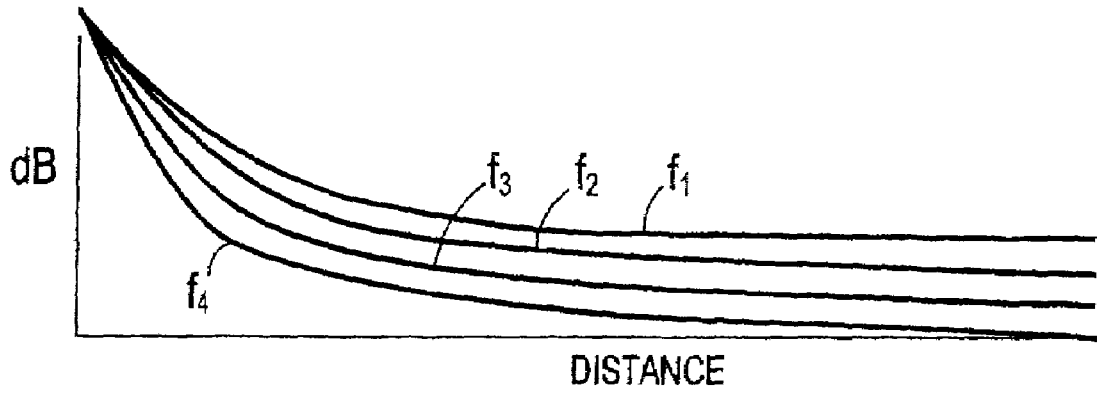
FIGS. 6*a* and 6*b* depict, respectively, the frequency-dependent decay of ultrasonic signals through the atmosphere and the result of correcting for this phenomenon.
Figure 6B:
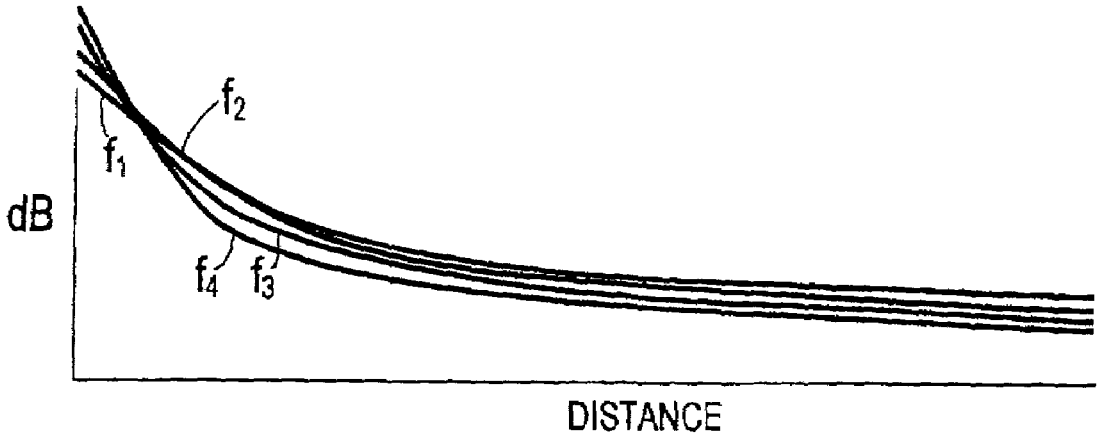

To further reduce audible distortion, the modulator 512 provides the modulated carrier signal to the matching filter 516, which adjusts the signal amplitude in proportion to the expected amount of decay at an assumed or actual distance from the acoustic transducer array 122 (see FIG. 1). Consequently, the curves representing the frequency-dependent decay of the ultrasonic signal through the atmosphere (see FIG. 6*a*) are brought closer together, as depicted in FIG. 6*b* (with the greatest power boost being applied to the highest frequency, $f_4$). Although the overall rate of decay is unchanged, the decay of the ultrasonic signal is not nearly as frequency dependent and therefore audibly distortive.

The correction introduced by the matching filter 516 may be further refined by employing a temperature/humidity sensor 530, which provides a signal to the matching filter 516 that can be used to establish an equalization profile according to known atmospheric absorption equations. Such equalization is useful over a relatively wide range of distances until the above-mentioned curves diverge once again (see FIG. 6B). In such cases, the correction may be improved by using beam geometry, phased array focusing, or any other technique to change the amplitude distribution along the length of the beam so as to compensate more precisely for absorption-related decay.

As described above, the presently disclosed parametric audio system reduces distortion in airborne audio signals by way of, e.g., nonlinear inversion of the audio signals and filtering of the modulated ultrasonic carrier signal. It should be understood that such reductions in audible distortion are most effectively achieved with an acoustic transducer, driver amplifier, and equalizer system that is capable of reproducing a relatively wide bandwidth.

Figure 7:
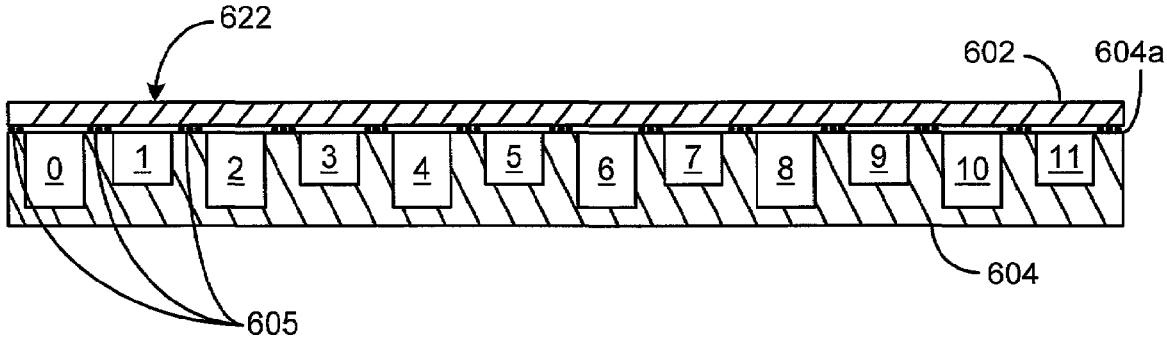
FIG. 7 is a cross-sectional view of an alternative embodiment of the acoustic transducer array of FIG. 2*a*.

FIG. 7 depicts a cross-sectional view of an acoustic transducer array 622, which is a preferred embodiment of the acoustic transducer array 122 (see FIGS. 2*a* and 2*b*). The acoustic transducer array 622 is configured to provide a relatively wide bandwidth, e.g., on the order of 5 kHz or higher. Like the acoustic transducers 0-11 included in the acoustic transducer array 122, each of the acoustic transducers 0-11 of the acoustic transducer array 622 is preferably a Sell-type electrostatic transducer. Accordingly, the acoustic transducer array 622 includes an electrically conductive membrane 602 disposed near an adjacent backplate electrode 604. Further, a surface 604*a* of the backplate electrode 604 is interrupted by a plurality of rectangular grooves to form the acoustic transducers 0-11. Thus, the acoustic transducer array 622 includes the plurality of acoustic transducers 0-11 as defined by the membrane 602 and respective edges of the plurality of rectangular grooves.

In this preferred embodiment, the grooves corresponding to the acoustic transducers 0, 2, 4, 6, 8, and 10 are deeper than the grooves corresponding to the acoustic transducers 1, 3, 5, 7, 9, and 11. The acoustic transducers 0, 2, 4, 6, 8, and 10 therefore have a lower center frequency than the acoustic transducers 1, 3, 5, 7, 9, and 11. It is noted that the use of uniform groove depths absent the matching filter is not recommended as it tends to reduce bandwidth owing very high resonance. The respective center frequencies are sufficiently spaced apart to provide the relatively wide bandwidth of at least 5 kHz. The backplate electrode 604 comprises a surface roughness 605 to provide damping and increase the bandwidth of the acoustic transducer array 622. Moreover, the membrane 602 may be configured with internal damping and/or another membrane or material (e.g., a piece of cloth; not shown) may be disposed near the membrane 602 to provide damping and further increase the bandwidth of the acoustic transducer array 622.

The foregoing acoustic transducer array configuration is easily manufactured using commonly available stamped or etched materials and therefore has a low cost. Further, components of the driver amplifier 118 (see FIG. 1) may be placed directly on a portion of the same substrate used to form the backplate electrode 204 (see FIG. 2*b*). The acoustic transducer array configuration is also light in weight and can be flexible for easy deployment, focusing, and/or steering of the array. It will also be appreciated that geometries, particularly the depths of the rectangular grooves formed in the backplate electrode 204, may vary so that the center frequencies of the individual acoustic transducers 0-11 span a desired frequency range, thereby broadening the overall response of the acoustic transducer array 122 as compared with that of a single acoustic transducer or an acoustic transducer array having a single center frequency.

It will further be appreciated by those of ordinary skill in the art that modifications to and variations of the above-described parametric audio system may be made without departing from the inventive concepts disclosed herein. Accordingly, the invention should not be viewed as limited except as by the scope and spirit of the appended claims.

What is claimed is:

1. A parametric audio system for generating at least one airborne audio beam, comprising:

at least one audio signal source configured to provide at least one audio signal;

at least one signal conditioner configured for receiving the at least one audio signal and for nonlinearly processing the audio signal to provide at least one pre-distorted signal;

a modulator configured to receive the pre-distorted signal and to convert the pre-distorted signal into ultrasonic frequencies; and an acoustic transducer array including plurality of acoustic transducers, the array being configured to receive the converted signal and to project the converted signal through the air along a selected path, thereby inverting distortion in the projected signal and regenerating the audio signal along at least a portion of the selected path with reduced net distortion, wherein the acoustic transducer array has a bandwidth greater than 5 kHz, and wherein the acoustic transducer array further includes:

a backplate having a surface and a succession of depressions formed on the surface, the respective depressions having different depths; and a membrane with at least one conductive surface adjacently disposed along the backplate, wherein the membrane and the succession of depressions define the plurality of acoustic transducers, each of the plurality of acoustic transducers having an associated center frequency determined at least in part by the depth of the respective depression;

wherein the depressions formed on the surface of the backplate alternate in succession between at least one depression having at least one first specified depth and at least one depression having at least one second specified depth, and wherein the spacing between the center frequencies determined at least in part by the at least one first specified depth and the at least one second specified depth is sufficient to obtain an aggregate frequency response of the acoustic transducer array having the bandwidth greater than 5 kHz.

2. The parametric audio system of claim 1 wherein each acoustic transducer is a Sell-type electrostatic transducer.

3. The parametric audio system of claim 1 wherein each acoustic transducer includes the membrane, a backplate electrode, and a DC bias source between the membrane and the backplate electrode.

4. The parametric audio system of claim 3 further including at least one driver amplifier coupled between the modulator and the acoustic transducer array and configured to receive the converted signal and to generate an amplified signal representative of the converted signal, and a blocking capacitor coupled between the driver amplifier and the acoustic transducer array and configured to block the DC bias from the driver amplifier.

5. The parametric audio system of claim 3 further including at least one driver amplifier coupled between the modulator and the acoustic transducer array and configured to receive the converted signal and to generate an amplified signal representative of the converted signal, and a first component coupled between the acoustic transducer array and the DC bias source and configured to block the amplified signal from the DC bias source.

6. The parametric audio system of claim 3 wherein the DC bias source is provided by an embedded charge.

7. The parametric audio system of claim 2 wherein the Sell-type electrostatic transducer includes the membrane, a backplate electrode, and a dielectric spacer disposed between the membrane and the backplate electrode.

8. The parametric audio system of claim 1 wherein each acoustic transducer is a Sell-type electrostatic transducer including the membrane, an electrode, and an insulative backplate disposed between the membrane and the electrode.

9. The parametric audio system of claim 1 wherein the signal conditioner is configured to perform nonlinear inversion of the audio signal to generate the pre-distorted signal.

10. The parametric audio system of claim 1 further including at least one driver amplifier coupled between the modulator and the acoustic transducer array and configured to receive the converted signal, wherein the converted signal is an undivided signal, wherein the driver amplifier is further configured to generate an amplified signal representative of the undivided converted signal, and a matching filter configured to compensate for a frequency response of the combination of the acoustic transducer array and the driver amplifier.

11. The parametric audio system of claim 1 wherein the acoustic transducer array has a loudness figure of merit, 1, defined according to the expression $$1=(\text{Area})\cdot(\text{Amplitude})^2, \quad (1)$$

wherein "Area" is the area of the acoustic transducer array, and "Amplitude" is the amplitude of the modulated carrier signal.

12. The parametric audio system of claim 11 wherein "1" is greater than $(2.0\times10^4)\ \text{Pa}^2\cdot\text{in}^2$.

13. The parametric audio system of claim 11 wherein "1" is greater than $(4.5\times10^5)\ \text{Pa}^2\cdot\text{in}^2$.

14. The parametric audio system of claim 1 further including at least one driver amplifier configured to receive the modulated carrier signal and to generate an amplified signal representative of the modulated carrier signal, wherein the acoustic transducer array has a mechanical-acoustic resonance, wherein the driver amplifier includes an inductor coupled to the acoustic transducer array to form a resonant circuit having a resonance frequency approximating both the frequency of the mechanical-acoustic resonance and the frequency of the ultrasonic carrier signal.

15. The parametric audio system of claim 14 wherein both the frequency of the mechanical-acoustic resonance and the frequency of the ultrasonic carrier signal are greater than or equal to 45 kHz.

16. The parametric audio system of claim 14 wherein the frequency of the ultrasonic carrier signal is greater than or equal to 55 kHz.

17. The parametric audio system of claim 14 wherein the driver amplifier further includes a damping resistor coupled between the inductor and the capacitive load of the acoustic transducer array.

18. The parametric audio system of claim 14 wherein the driver amplifier further includes a step-up transformer and the inductor is provided by the step-up transformer.

19. A parametric audio system for generating at least one airborne audio beam, comprising:

at least one audio signal source configured to provide at least one audio signal;

at least one signal conditioner configured for receiving the at least one audio signal and for nonlinearly processing the audio signal to provide at least one pre-distorted signal;

a modulator configured to receive the at least one pre-distorted signal and to convert the pre-distorted signal into ultrasonic frequencies;

at least one driver amplifier configured to receive the at least one converted signal, wherein the at least one converted signal is an undivided signal, the at least one driver amplifier being further configured to generate at least one amplified signal representative of the undivided converted signal;

an acoustic transducer array including a plurality of acoustic transducers, the array being configured to receive the at least one amplified signal and to project the amplified signal through the air for inverting distortion in the projected signal and for subsequent regeneration of the audio signal with reduced net distortion;

a matching filter configured to compensate for a frequency response of the combination of the acoustic transducer array and the driver amplifier; and a delay circuit configured to apply at least one predetermined time delay to the at least one converted signal, wherein the acoustic transducer array further includes:

a backplate having a surface and a succession of depressions formed on the surface, the respective depressions having different depths; and a membrane with at least one conductive surface adjacently disposed along the backplate;

wherein the membrane and the succession of depressions define the plurality of acoustic transducers, each of the plurality of acoustic transducers having an associated center frequency determined at least in part by the depth of the respective depression;

wherein the depressions formed on the surface of the backplate alternate in succession between at least one depression having at least one first specified depth and at least one depression having at least one second specified depth, and wherein the spacing between the center frequencies determined at least in part by the at least one first specified depth and the at least one second specified depth is sufficient to obtain an aggregate frequency response of the acoustic transducer array having a bandwidth greater than 5 kHz.

20. The parametric audio system of claim 19 wherein the delay circuit is configured to apply the at least one predetermined time delay to the at least one converted signal to steer the converted signal through the air along at least one path by the acoustic transducer array.

21. The parametric audio system of claim 19 wherein the delay circuit is configured to apply a predetermined time delay, d, according to the expression $d=(x\cdot\sin(\theta))/c$, wherein "x" is the distance from a datum to a respective acoustic transducer and "c" is the speed of sound.

22. An acoustic transducer array, comprising:

a backplate including a surface and a succession of depressions formed on the surface, the respective depressions having different depths; and a membrane with at least one conductive surface adjacently disposed along the backplate, wherein the acoustic transducer array has a bandwidth greater than 5 kHz, wherein the membrane and the succession of depressions define the plurality of acoustic transducers, each of the plurality of acoustic transducers having an associated center frequency determined at least in part by the depth of the respective depression, wherein the depressions formed on the surface of the backplate alternate in succession between at least one depression having at least one first specified depth and at least one depression having at least one second specified depth, and wherein the spacing between the center frequencies determined at least in part by the at least one first specified depth and the at least one second specified depth is sufficient to obtain an aggregate frequency response of the acoustic transducer array having the bandwidth greater than 5 kHz.

* * * * *

UNITED STATES PATENT AND TRADEMARK OFFICE

CERTIFICATE OF CORRECTION

PATENT NO. : 7,391,872 B2 
APPLICATION NO. : 09/758606
DATED : June 24, 2008
INVENTOR(S) : Frank Joseph Pompei It is certified that error appears in the above-identified patent and that said Letters Patent is hereby corrected as shown below:

Column 9, line 37, "$p'(t) = P_1(L(t) + m\iint g(t0dt^2)^{1/2}\sin(\omega_c t), \quad (6)$" should read, --$p'(t) = P_1(L(t) + m\iint g(t)dt^2)^{1/2}\sin(\omega_c t), \quad (6)$--;

Column 9, lines 49-50, "$p'_2(t) \propto d^2E^2(t)/dt^2 p'_2(t) \propto d^2(L(t) + m\iint g(t)dt^2)/dt^2 p'_2(t) \propto d^2L(t)/dt^2 + mg(t). \quad (7)$", should read, $$--p'_2(t) \propto d^2E^2(t)/dt^2 \quad (7)$$
$$p'_2(t) \propto d^2(L(t) + m\iint g(t)dt^2/dt^2$$
$$p'_2(t) \propto d^2L(t)/dt^2 + mg(t).--; \text{ and}$$

Column 12, lines 46-50,

"wherein the membrane-type transducer has a loudness figure of merit, 1, defined according to the expression $$1 = (\text{Area}) \bullet (\text{Amplitude})^2, \quad (1)"$$

should read,

--wherein the membrane-type transducer has a loudness figure of merit, 1, defined according to the expression $1 = (\text{Area}) \bullet (\text{Amplitude})^2$, and--.

Signed and Sealed this

Twenty-third Day of June, 2009

JOHN DOLL
*Acting Director of the United States Patent and Trademark Office*